US006454593B1

(12) United States Patent
Michelbach et al.

(10) Patent No.: US 6,454,593 B1
(45) Date of Patent: Sep. 24, 2002

(54) ELECTRICAL DEVICE

(75) Inventors: Thomas Michelbach, Bad Mergentheim (DE); Gisbert Schmahl, Igersheim (DE); Hans-Martin Lösch, Würzburg (DE); Reinhold Barlian, Max-Eyth-Strasse 16, D-97980 Bad Mergentheim (DE)

(73) Assignee: Reinhold Barlian, Bad Mergentheim (DE)

( * ) Notice: Subject to any disclaimer, the term of this patent is extended or adjusted under 35 U.S.C. 154(b) by 0 days.

(21) Appl. No.: 09/647,256

(22) PCT Filed: Mar. 18, 1999

(86) PCT No.: PCT/DE99/00856

§ 371 (c)(1),
(2), (4) Date: Nov. 8, 2000

(87) PCT Pub. No.: WO99/49538

PCT Pub. Date: Sep. 30, 1999

(30) Foreign Application Priority Data

Mar. 23, 1998 (DE) ..... 198 12 635

(51) Int. Cl.[7] ..... H01R 4/24
(52) U.S. Cl. ..... 439/412; 439/425; 439/427
(58) Field of Search ..... 439/412, 417, 439/425, 413, 411, 428, 427

(56) References Cited

U.S. PATENT DOCUMENTS

| | | | | |
|---|---|---|---|---|
| 2,235,231 A | | 3/1941 | Mattis | |
| 4,525,019 A | | 6/1985 | Brasky | |
| 4,773,876 A | * | 9/1988 | Nakamura et al. | 439/417 |
| 5,174,783 A | | 12/1992 | Stassen et al. | |
| 5,599,202 A | * | 2/1997 | Key | 439/459 |
| 5,662,492 A | * | 9/1997 | Weiss | 439/404 |
| 5,833,487 A | * | 11/1998 | Joly | 439/404 |
| 5,989,056 A | * | 11/1999 | Lange et al. | 439/412 |
| 6,113,420 A | * | 9/2000 | Haring et al. | 439/459 |

FOREIGN PATENT DOCUMENTS

| | | |
|---|---|---|
| EP | 0505911 | 9/1992 |
| FR | 2744567 | 8/1997 |

* cited by examiner

*Primary Examiner*—Tho D. Ta
*Assistant Examiner*—Phuong Nguyen
(74) *Attorney, Agent, or Firm*—Horst M. Kasper

(57) ABSTRACT

The invention relates to a device for contacting at least one electrical conductor. A clamping contact blade can be passed against the conductor at an acute angle. The conductor can be inserted into a channel of an insulating part, which channel is bent such as to form an acute angle in relation to the conductor.

50 Claims, 5 Drawing Sheets

ELECTRICAL DEVICE

CROSS-REFERENCES TO RELATED APPLICATIONS (not applicable)

Figure 7:
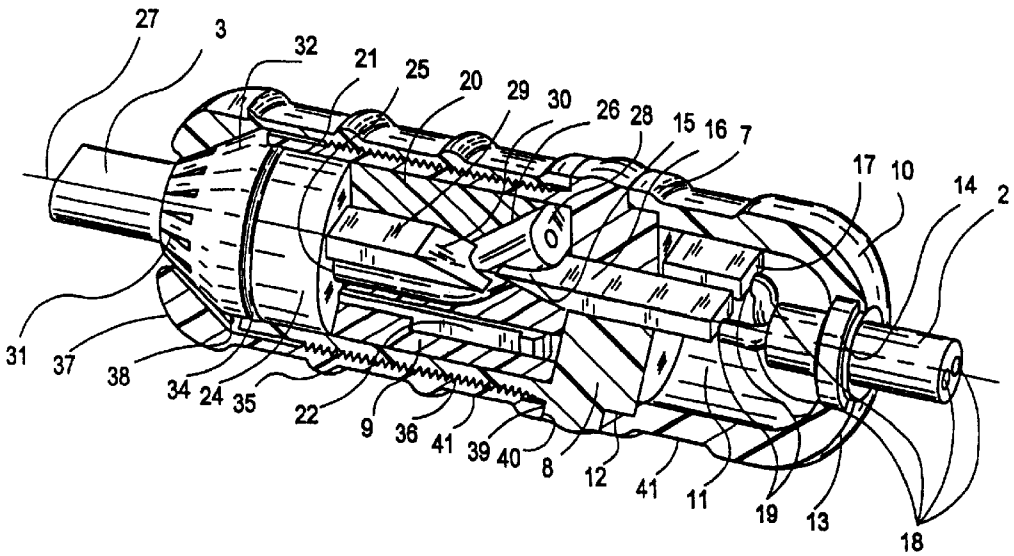
Figure 6:
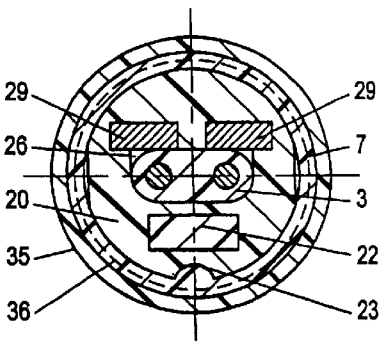

STATEMENT REGARDING FEDERALLY SPONSORED RESEARCH OR DEVELOPMENT (not applicable)

REFERENCE TO A "MICROFICHE APPENDIX" (SEE 37 CFR 1.96)

(not applicable)

BACKGROUND OF THE INVENTION

1. Field of the Invention

The invention relates to a device for contacting at least one electrical conductor.

2. Description of the Related Art including information disclosed under 37 CFR 1.97 and 1.98

This object is accomplished according to the present invention.

BRIEF SUMMARY OF THE INVENTION

The object of the invention comprises to further develop a device for contacting at least one electrical conductor in such way that a quickly and safely performable mounting by hand and electrical conductor contacting is accomplished with simple means without loseable small parts such as screws and to the like.

This object is accomplished according to the present invention by a heating conductor of a heating cable, characterized in that the end part (28) of the condductor (5, 6) is slidable into a channel (26) of an insulator piece (20) at an acute angle relative to the longitudinal axis (27) of the conductor (5, 6) and wherein a contact clamping cutting edge (15, 53) is staggered and substantially parallel to the longitudinal axis (27) at an acute angle pressable against the conductor (5, 6) in the region of the end part (28)

BRIEF DESCRIPTION OF THE SEVERAL VIEWS OF THE DRAWING(S)

Figure 1:
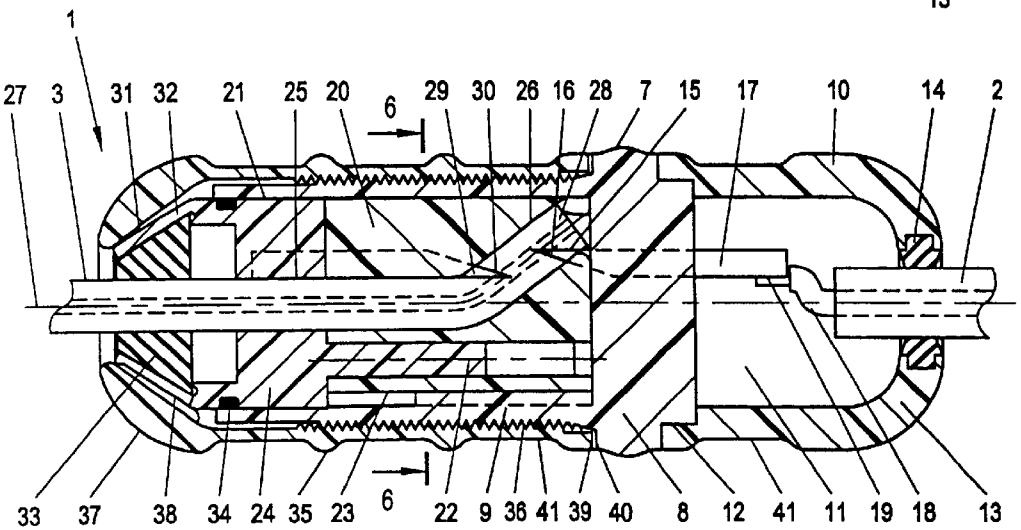
Figure 2:
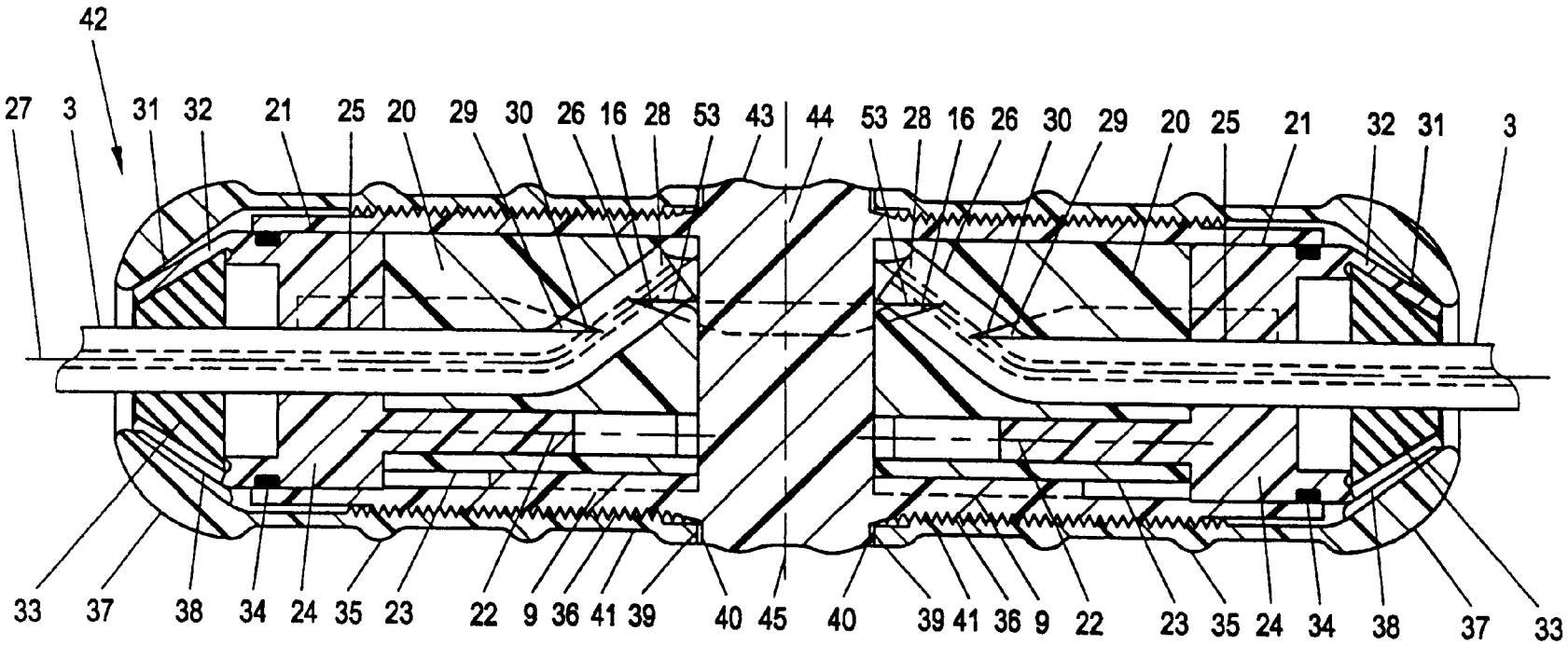
Figure 3:
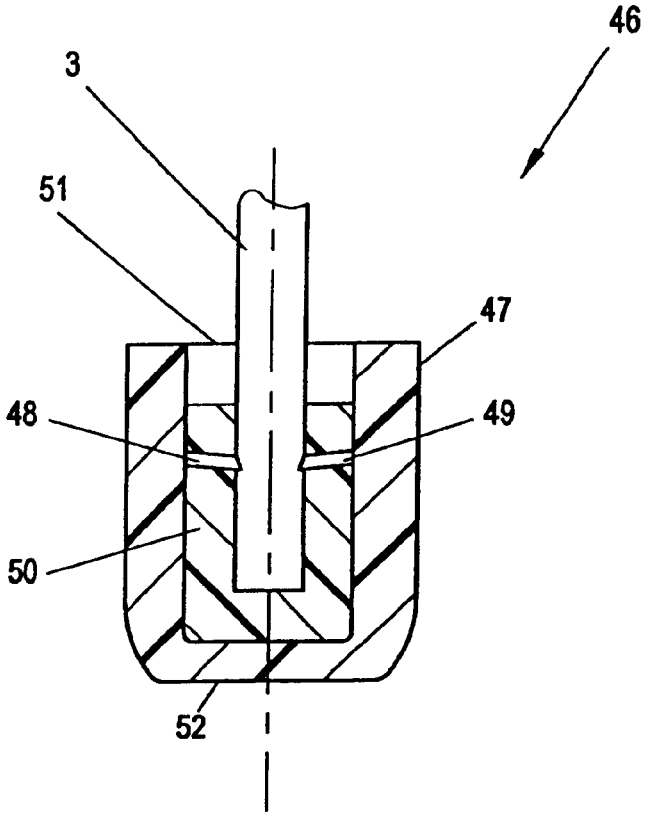
Figure 4:
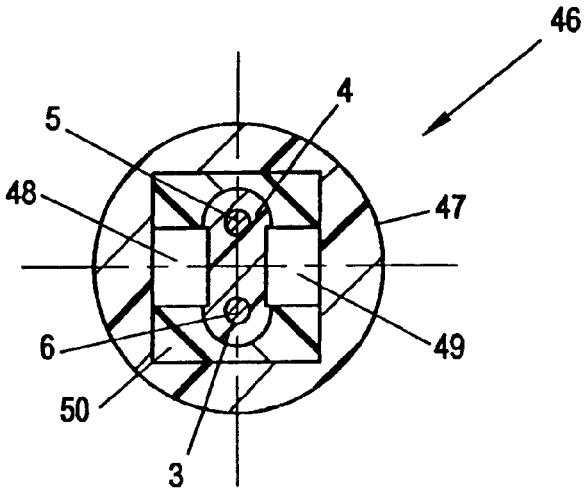
Figure 5:
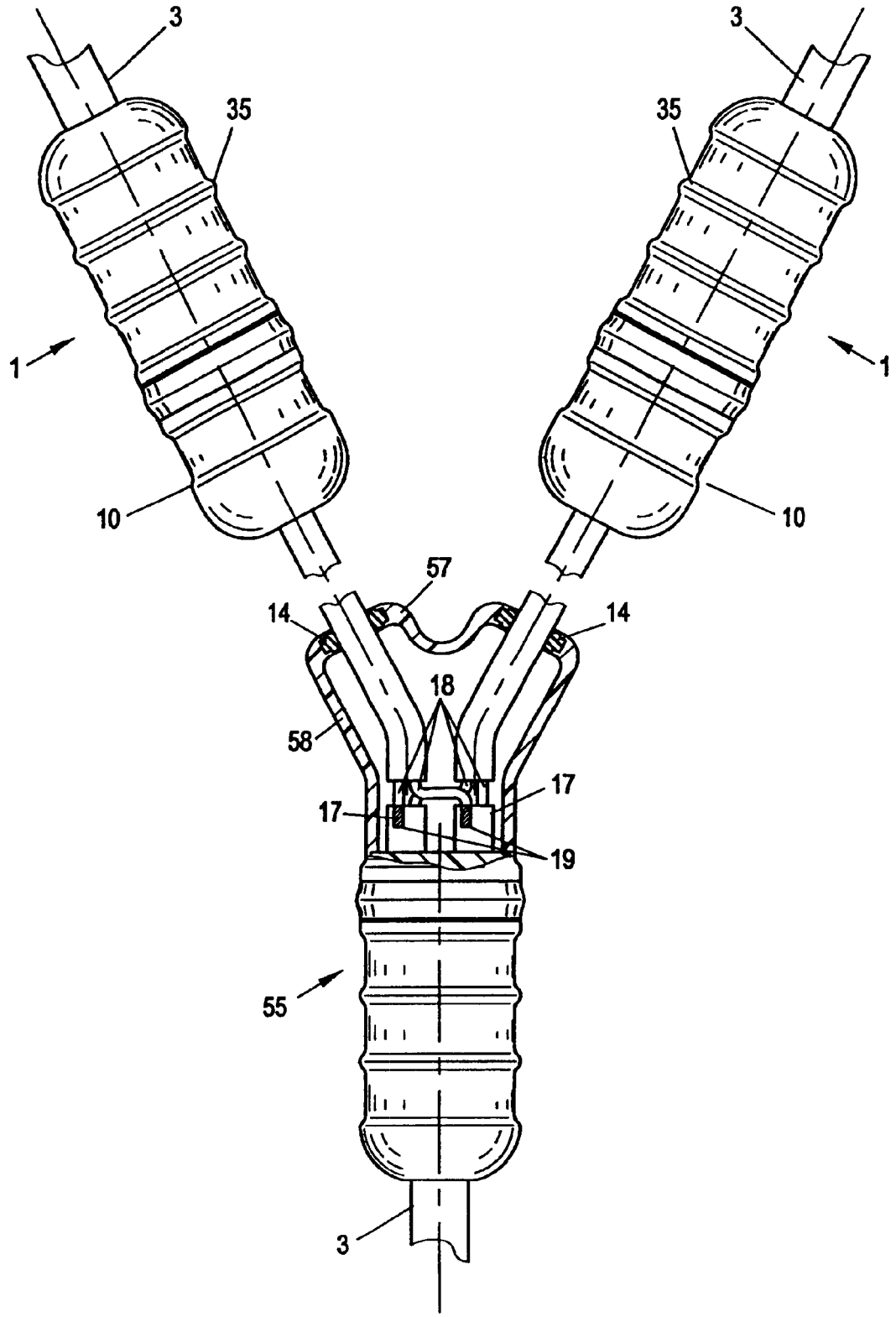
Figure 10:
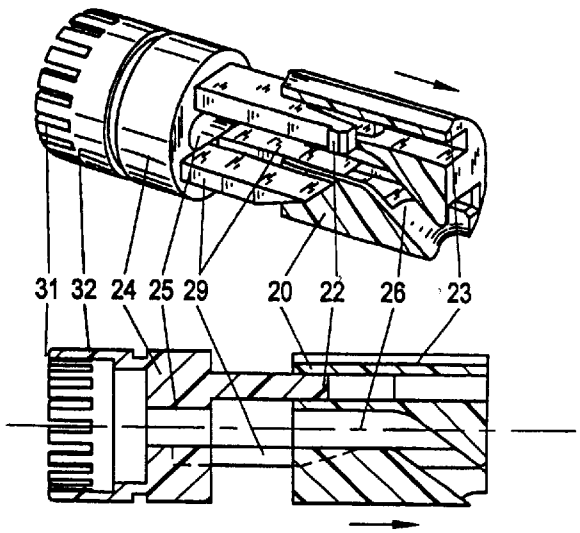
Figure 9:
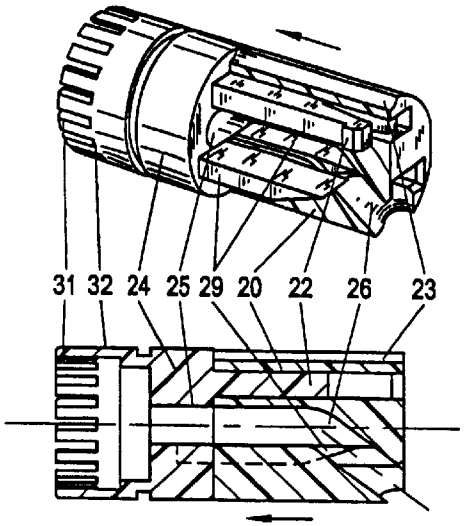
Figure 8:
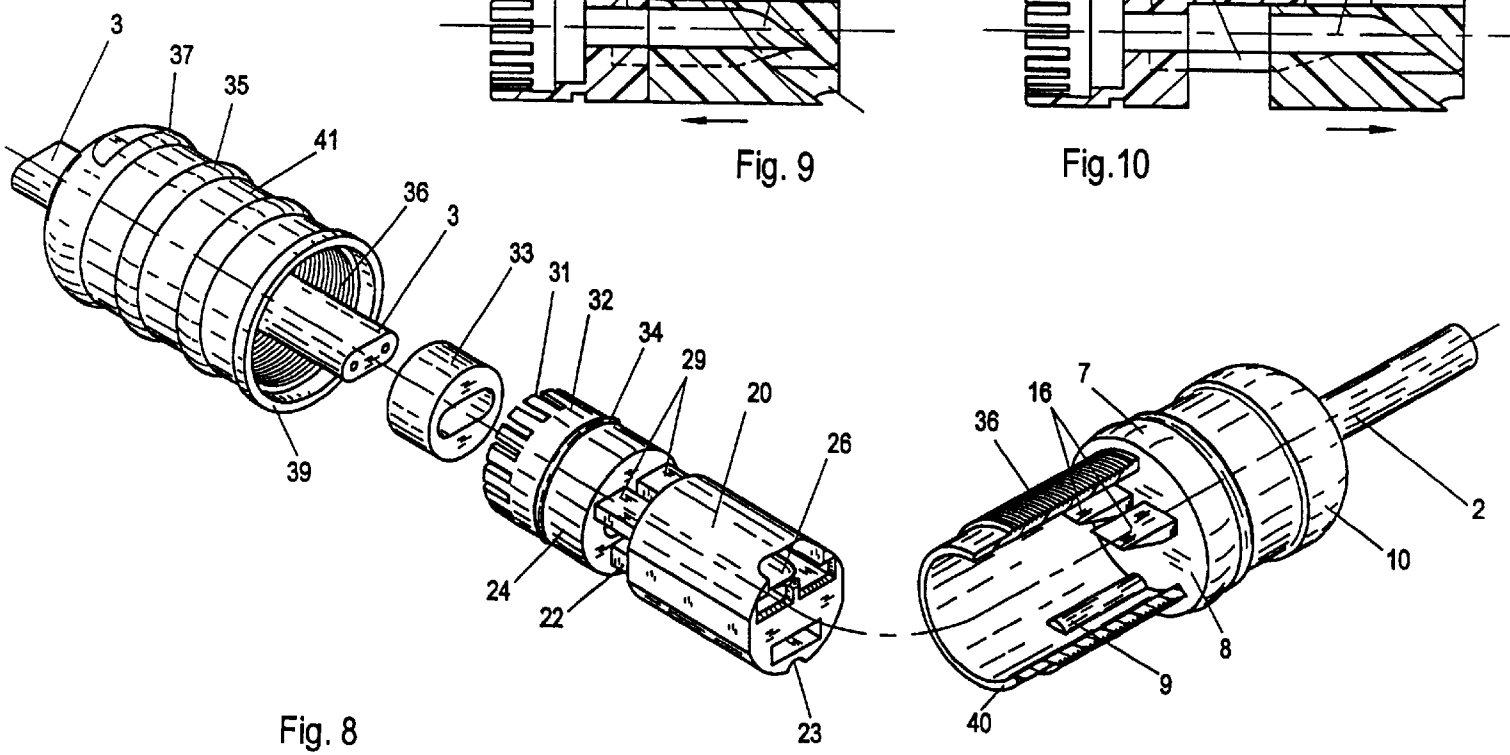

Further advantages and essential details of the invention can be gathered from the following description and the drawing, which shows preferred embodiments as an example in a schematic representation. There's shown in:

FIG. 1 a connector bushing in a sectional side elevational view,

FIG. 2 a connection sleeve in a sectional side elevational view,

FIG. 3 an end bushing in a sectional side elevational view,

FIG. 4 the end bushing according to FIG. 3 in a different sectional view, and FIG. 5 a Y-branching in a side elevational view, partially in section.

DETAILED DESCRIPTION OF THE INVENTION

This object is accomplished according to the present invention by a heating conductor of a heating cable, characterized in that the end part (28) of the conductor (5,6) is slidable into a channel (26) of an insulator piece (20) at an acute angle relative to the longitudinal axis (27) of the conductor (5,6) and wherein a contact clamping cutting edge (15, 53) is staggered and substantially parallel to the longitudinal ais (27) at an acute angle pressable against the conductor (5,6) in the region of the end part (28).

The device according to the present invention illustrated in the drawing is formed according to FIG. 1 as a connector bushing 1, which exhibits an electrical connection cable 2 on the one side and an electrical heating cable 3 on the oppositely disposed side. The connection cable 2 can be a tubular conductor having a circular cross-section, whereas the heating cable 3, which is not furnished with an outer protection conductor braid but is formed as a protection insulated heating band with a double or reinforced insulation, having advantageously a flat rectangular cross-section and exhibiting preferably two conductors 5, 6, which are disposed next to each other at a distance.

The bushing 1 exhibits a nearly pot shaped clamping cut casing 7, which has a floor 8 and anullar wall 9. A casing cap 10 is disposed at the floor 8, wherein the casing cap 10 co-delimits a connection chamber 11 and wherein the casing cap 10 is advantageously sealingly connected to the floor 8 by a device side ultrasound welding 12. A sealing ring 14 is integrated in the rear wall 13 of the casing cap 10, and the connection cable 2 is led into the connection chamber 11 through the sealing ring 14, wherein the sealing ring 14 sealingly surrounds the connection cable 2, such that the connection chamber 11 is shielded against outer influences. The casing cap 10 and the sealing ring 14 are advantageously produced by a two component injection molding method.

Two contact clamping cutting edges 15 can be disposed in the floor 8 of the clamping cut casing 7, wherein the distance of the two contact clamping cutting edges 15 from each other is essentially like the distance of the conductor 5, 6 of the heating cable 3. The contact clamping cutting edges 15 penetrate the floor 8 and protrude with their cutting edge 16 into the pot shaped space-of the clamping cut casing 7. The other end of the contact clamping cutting edges 15 disposed remote relative to the cutting edge 16 is formed as a connection lug or tag 17, which protrude into the connection chamber 11 and wherein in each case an electric conductor 18 of the connection cable 2 is connected on the device side preferably with a point welding 19 to the connection lug or tag 17.

An insulator piece 20 secured against rotating and a clamping cut bush 21 are disposed in the clamping cut casing 7, wherein the clamping cut bush 21 is insertable into the insulator piece 20 from the side disposed opposite to the floor 8 and wherein the clamping cut bush 21 is coupled axially shiftable with the latter insulator piece 20 on the device side to a device unit. For this purpose a locking web 22 formed at a base wall 24 of the clamping cut bush 21 is limited slidably supported in a guide recess 23 of the insulator piece 20. According to the present embodiment the locking web 22 can be pulled out by about from 10 to 15 mm until projections formed at the locking web 22 strike and prevent a further pulling apart of the parts. A passage 25 is formed in the base wall 24 of the clamping cut bush 21, wherein the heating cable 3 is slipped through the passage 25. This passage 25 is essentially congruent with a channel 26, wherein the channel 26 is disposed in the insulator piece 20. Such as a passage 25, also the start of the channel 26 runs initially in the plane of the longitudinal axis 27 of the connector bushing 1. Then, however, the channel 26 bends off with an acute angle of preferably about 20 degrees to 35 degrees and runs at an inclined angle downwardly according to the drawing representation. The cross-section of both the passage 25 as well as of the channel 26 can be formed flat rectangular and can be essentially equal to the cross-section of the heating cable 3, wherein the end piece 28 of the heating cable 3 is thus disposed under restrictive guidance in the channel 26.

Clamping cutting edges 29 can be disposed at the base wall 24 of the clamping cut bush 21, wherein the distance of the clamping cutting edges 29 relative to each other is equal to the distance of the two contact clamping cutting edges 15 as well as the distance of the two conductors 5, 6 of the heating cable. The clamping cutting edges 29 stand essentially parallel to the locking web 22 and are disposed opposite to the contact clamping cutting edges 15 of the clamping cut casing 7. It is thereby to be recognized that the cutting edge 30 of the clamping cutting edges 29 is somewhat height level staggered relative to the cutting edge 16 of the contact clamping cutting edge 15 and as that a distance is present between the two cutting edges 16, 30, wherein the distance is smaller than the thickness of the heating cable 3. The end part 28 of the heating cable 3 is slipped into the channel 26 of the insulator piece 20 up to the stop at the floor 8 of the clamping cut casing 7.

The a clamping cut bush 21 exhibits a lamella ring 31 at the side of the base wall 24 disposed opposite to the locking web 22, wherein the lamella ring 31 is formed of spring elastic fingers 32. The fingers 32 of the lamella ring 31 surround a rubber elastic seal 33, wherein the heating cable 3 is led through the rubber elastic seal 33. In addition an anullar groove is formed at the circumference of the clamping cut bush 21, wherein a ring seal 34 preferably formed as an O-ring is disposed in the anullar groove, wherein the ring seal 34 sealingly rests at the inner face of the clamping cut casing 7.

Finally the connector bushing 1 is furnished further with an outer tubular casing part 35, wherein the outer tubular casing part 35 is furnished with an internal thread, wherein the internal thread engages with an outer thread of the clamping cut casing 7 and is disengageably connected to the clamping cut casing 7 through the thus formed screw threading 36. A funnel shaped narrowing collar 37 is formed at the one end of the casing part 35, wherein the collar 37 presses the fingers 32 of the lamella ring 31 in the direction of the longitudinal axis 27 against the seal 33 upon screwing onto clamping cut casing 7. A web 38 can be furnished at the inner side of the funnel shaped collar 37, wherein the web 38 engages into a slot formed between the fingers 32. The front face 39 of the end of the casing part 35 disposed opposite to the collar 37 is disposed at a shoulder 40 formed at the clamping cut casing 7 in the closure position of the connector bushing 1. As can be further gathered from the drawing, recessed grips 41 can be formed at the casing cap 10 as well as at the casing part 35 capable of being screwed on, such as that the connector bushing 1 can be captured nonskid and slide resistant for the mounting and demounting by hand.

Initially the casing part 35 is slid onto the heating cable 3 during the mounting on the side of the customer. Then the end part 28 of the heating cable 3 is slid into the channel 26 of the insulator piece 20 up to the end without any insulating or other preparatory work through the seal 33 and the passage 25 of the clamping cut bush 21. The insulator piece 20 is thereby pressed away axially so far from the clamping cut bush 21 until the projections of the locking web 22 prevent a further sliding away. Since the channel 26 is bent downwardly at an acute angle, the end part 28 of the heating cable 3 is necessarily correspondingly deflected into the channel 26. Since the insulator piece 20 is pressed away from the clamping cut bush 21 upon sliding in of the heating cable 3, there occurs no touching with the clamping cutting edge 29, since the latter clamping cutting edge 29 initially does not protrude into the channel 26. Then the insulator piece 20 and the clamping cut bush 21 are inserted into the clamping cut casing 7 in a position restrictively guided against rotation, wherein the conductors 5, 6 are disposed in the proper position relative to the cutting edges 16, 30. Then the casing part 35 is screwed on to the clamping cut casing 7. The insulator piece 20 and the clamping cut bush 21 are thereby slid into the clamping cut casing 7, until the front face of the insulator piece 20 and the end part 28 of the heating cable 3 strike at the floor 8. The cutting edges 16 of the contact clamping cutting edge pair 15 from above and the cutting edges 30 of the clamping cutting edge pair 29 from below slide through the not removed insulator jacket 4 of the heating cable 3 into the individual conductors 5, 6 during this process, wherein the individual conductors 5, 6 are clamped essentially meander shaped between the cutting edge pairs 15, 29. This provides a secure electrical contacting with the contact clamping cutting edges 15. The clamping cutting edges 29 support the conductors 5, 6 and thereby prevent any escaping of the conductors 5, 6. The fingers 32 of the lamella ring 31 are pressed by the collar 37 against the seal 33 upon screwing on of the casing part 35, wherein the seal 33 sealingly surrounds thereby the heating cable 3. The casing part 35 is screwed on advantageously to such extent until the front side 39 rests at the shoulder 40 of the clamping cut casing 7. It is thereby assured that the contact clamping cutting edges 15 are optimally electrically contacted with the conductors 5, 6.

The connection sleeve 42 illustrated in FIG. 2 serves for connecting for example to heating cable 3 and is furnished with a double pot shaped clamping cut casing 43, wherein in each case an anullar wall 9 is furnished at the floor 44 of the double pot shaped clamping cut casing 43 at two oppositely disposed sides. The connection sleeve 42 can advantageously be formed mirror symmetrically relative to a center plane 45 disposed in the middle of the floor 44 and perpendicular to the longitudinal axis 27. The clamping cut casing 43 can exhibit for this purpose in each case an insulator piece 20, a clamping cut bush 21, a seal 33, an anullar seal 34, and a screwable casing part 35 at the two sides of the floor 44. The contact clamping cutting edges 53 disposed in the floor 44 are not furnished with a connection lug or tag, but two cutting edges 16 protruding from the floor 44, wherein the cutting edges 16 direct into directions disposed opposite to each other for the contacting and the electrical connection of the conductors 5, 6 of the two heating cables 3. The connection of the heating cable 3 on the side of the customer is performed by the connection sleeve 42 sensibly according to the above described connection of the heating cable 3 to the connector bushing 1.

The end bushing 46 of FIGS. 3 and 4 is furnished with a pot shaped plastic casing 47, wherein the pot shaped plastic casing 47 exhibits support webs 48, 49 formed at oppositely disposed wall parts. In addition, an insulating plastic mass 50 is disposed in the plastic casing 47, wherein the consistency of the insulating plastic mass 50 is gel like. The end of the heating cable 3 is pressed into the gel like plastic mass 50 through the opening 51 of the plastic casing 47 up to the floor wall 52. The support webs 48 are thereby to some extent bend over by the heating cable 3 in the insertion direction. After the heating cable 3 has been slid up to the floor wall 52, then the heating cable 3 is to some extent retracted, until that the heating cable 3 passes into the position illustrated in FIG. 3. Here the free ends of the support webs 48 engage into the insulating jacket 4 of the heating cable 3 and prevent a further pulling back, such that the heating cable 3 is problem free sealed and fixedly positioned in the plastic casing 47.

Three heating bands 3 are furnished in connection with the Y-branching 54 illustrated in FIG. 5. A heating circuit is thus subdivided into two further heating circuits with the branching bush 55. For this purpose the branching bush 55 exhibits a casing 56, wherein two sealing rings 14 are integrated in the wall 57 of the casing cap 56, wherein in each case an electrical connection cable, which can be furnished like the connection cable 2, is led into the connection chamber 58 through the two sealing rings 14. Here again the electrical conductors 18 can be attached preferably by point welding 19 at the connection lugs or tags 17 of the contact clamping cutting edges. The remaining part of the branching bush 55 is constructed like the connector bushing 1 for the connection of the heating cable 3. The two connection cables 2 led out from the branching bush 55 and the other two heating cables 3 are connected as described above in the connector bushings 1.

What is claimed is:

1. A device for contacting of at least one electrical conductor comprising an insulator piece (20) having a channel (26);

a member selected from the group consisting of a connector bushing (1), a connection sleeve (42), and a branching bushing (55), said member having a longitudinal axis (27);

a conductor (5,6) having an end piece (28), wherein the end piece (28) of the conductor (5,6) is slidable into the channel (26) of the insulator piece (20) at an acute angle relative to the longitudinal axis (27);

a clamping cut casing (7,43);

a contact clamping cutting edge (15,30) staggered and essentially parallel to the longitudinal axis (27) furnished in the clamping cut casing (7,43) is pressable against the conductor (5,6) in the region of the end part (28) at an acute angle upon insertion of the insulator piece (20) into the member in the direction of the longitudinal axis (27).

2. A device for contacting of at least one electrical conductor, in particular a heating conductor of a heating cable, characterized in that the end piece (28) of the conductor (5,6) is slidable into a channel (26) of an insulator piece (20) at an acute angle relative to the longitudinal axis (27) of a connector bushing (1), of a connection sleeve (42) or of a branching bushing (55) and that upon insertion of the insulator piece (20) into the connector bushing (1), the connection sleeve (42) or the branching bushing (55) in the direction of the longitudinal axis (27), a contact clamping cutting edge (15,30) staggered and essentially parallel to the longitudinal axis (27) furnished in a clamping cut casing (7,43) is pressable against the conductor (5,6) in the region of the end part (28) at an acute angle wherein a clamping cutting bush (21) is slidable in at the side of the clamping cut casing (7, 43) disposed opposite to a floor (8, 44) of the clamping cut casing (7), wherein the clamping cutting bush (21) exhibits a passage (25) for the conductor (5, 6) or for the heating cable (3) in a base wall (24) of the clamping cutting bush (21);

wherein the clamping cutting bush (21) exhibits at least one clamping cutting edge (29), wherein the clamping cutting edge (29) is disposed opposite to the contact clamping cutting edge (15, 30).

3. Device according to claim 2, characterized in that the insulator piece (20) is secured against rotations supported in the clamping cut casing (7,43).

4. Device according to claim 2, characterized in that the conductors (5,6) of the heating cable (3) are resting with a distance next to each other and wherein the heating cable (3) exhibits an about flat rectangular shaped cross-section.

5. Device according to claim 2, characterized in that the heating cable (3) is formed protectively insulated without a protective conductor braid with a doubled or reinforced insulation.

6. Device according to claim 2, characterized in that the connection sleeve (42) is mirror symmetrical relative to a center plane (45) of the clamping cut casing (43) disposed perpendicular to the longitudinal axis (27), said connection sleeve (42) having a clamping cut casing (43) as well as in each case two insulator pieces (20), clamping cutting bushes (21), seals (33), ring seals (34) and casing parts (35).

7. Device according to claim 2, characterized in that at least two connection cables (2) surrounded by in each case a sealing ring (14) are led through the wall (57) of the casing cap (56) into the connection chamber (58).

8. Device according to claim 2, characterized in that the casing cap (10, 56) and/or the casing part (35) of the connector bushing (1), of the connection sleeve (42), and of the branching bushing (55) exhibit at least one gripping recess (41) on the outside.

9. Device according to claim 1, characterized in that a distance exists between the cutting edge (16) of the contact clamping cutting edge (15, 53) and the cutting edge (30) of the clamping cutting edge (29) and wherein the cutting edge (30) of the clamping cutting edge (29) is disposed staggered in height relative to the cutting edge (16) of the contact clamping cutting edge (15, 53).

10. The device according to claim 2, characterized in that the contact clamping cutting edge (15, 53) is fixed in a floor (8, 44) of the clamping cut casing (7,43).

11. Device according to claim 10, characterized in that the end part (28) of the conductor (5,6) or of the heating cable (3) rests at the floor (8, 44) of the clamping cut casing (7,43).

12. Device according to claim 1, characterized in that the insulator piece (20) and the clamping cutting bush (21) are coupled axially shiftable to each other, wherein a locking web (22) of the clamping cutting bush (21) is supported limited slidable in a guide recess (23) of the insulator piece (20).

13. Device according to claim 12, characterized in that the clamping cutting bush (21) exhibits a lamellar ring (31) formed of spring elastic fingers (32) on the side disposed remote relative to the insulator piece (20), wherein they lamellar ring (31) surrounds a seal (33), wherein the conductor (5, 6) or the heating cable (3) are led through the seal (33).

14. Device according to claim 12, characterized in that the clamping cutting bush (21) exhibits an anullar groove, wherein a ring seal (34) resting at the inner side of the clamping cut casing (7, 43) is supported in the anullar groove.

15. Device according to claim 2, characterized in that the bushing (1,42, 55) exhibits a casing part (35) gripping over the clamping cut casing (7,43), wherein the casing part (35) is connected to the clamping cut casing (7,43) through a screw winding (36).

16. Device according to claim 15, characterized in that casing part (35) exhibits a narrowing collar (37), wherein the narrowing collar (37) is pressable conically against the lamellar ring (31).

17. Device according to claim 16, characterized in that the collar (37) of the casing part (35) exhibits a web (38), wherein the web (38) engages into a slot between the fingers (32) of the lamellar ring (31).

18. Device according to claim 16, characterized in that the front face (39) of the casing part (35) disposed remote to the collar (37) rests at a shoulder (40) of the clamping cut casing (7,43).

19. Device according to claim 2, characterized in that a casing cap (10, 56) co-delimiting the connector chamber (11, 58) is disposed at the floor (8) of the clamping cut casing (7).

20. Device according to claim 19, characterized in that the end of a connection cable (2) is led into the connection chamber (11,58) through the wall (13, 57) of the casing cap (10, 56) and at least one electrical conductor (18) of the connection cable (2) is connected to a connection lug or tag (17) of the contact clamping cutting edge (15, 53).

21. Device according to claim 20, characterized in that the electrical conductor (18) of the connection cable (2) is attached by way of a point welding (19) to the connection lug or tag (17).

22. Device according to claim 20, characterized in that the connection cable (2) is surrounded by a sealing ring (14) disposed in the wall (13, 57) of the casing cap (10, 56).

23. Device according to claim 20, characterized in that the casing cap (10, 56) is sealingly connected to the clamping cut casing (7,43) through an ultrasound welding (12).

24. Device according to claim 23, characterized in that the plastic casing (47) exhibits at least one and preferably two oppositely disposed support webs (48,49), wherein the free ends of the support webs (48,49) engage into the insulating jacket (4) of the heating cable (3).

25. Device according to claim 23 characterized in that at least two connection cables (2) surrounded by in each case a sealing ring (14) are led through the wall (57) of the casing cap (56) into the connection chamber (58).

26. Device according to claim 23, characterized in that the casing cap (10, 56) and/or the casing part (35) of the connector bushing (1), of the connection sleeve (42), and of the branching bushing (55) exhibit at least one gripping recess (41) on the outside.

27. A device for contacting of at least one electrical conductor comprising an insulator piece (20) having a channel (26);

a member selected from the group consisting of a connector bushing (1), a connection sleeve (42), and a branching bushing (55), said member having a longitudinal axis (27), wherein an end piece (28) of a conductor (5,6) is slidable into the channel (26) of the insulator piece (20) at an acute angle relative to the longitudinal axis (27);

a clamping cut casing (7,43);

a contact clamping cutting edge (15,30) staggered and essentially parallel to the longitudinal axis (27) furnished in the clamping cut casing (7,43) is pressable against the conductor (5,6) in the region of the end part (28) at an acute angle upon insertion of the insulator piece (20) into the member in the direction of the longitudinal axis (27);

wherein a clamping cutting bush (21) disposed slidable in at the side of the clamping cut casing (7, 43) and disposed opposite to a floor (8, 44) of the clamping cut casing (7), wherein the clamping cutting bush (21) exhibits a passage (25) for the conductor (5, 6) or for the heating cable (3) in a base wall (24) of the clamping cutting bush (21);

wherein the clamping cutting bush (21) exhibits at least one clamping cutting edge (29), wherein the clamping cutting edge (29) is disposed opposite to the contact clamping cutting edge (15, 53).

28. The device according to claim 27, wherein the insulator piece (20) is secured against rotations supported in the clamping cut casing (7,43).

29. The device according to claim 27, wherein a distance exists between the cutting edge (16) of the contact clamping cutting edge (15, 53) and the cutting edge (30) of the clamping cutting edge (29) and wherein the cutting edge (30) of the clamping cutting edge (29) is disposed staggered in height relative to the cutting edge (16) of the contact clamping cutting edge (15, 53).

30. The device according to claim 27, wherein the conductors (5,6) of a heating cable (3) are resting with a distance next to each other and wherein the heating cable (3) exhibits an about flat rectangular shaped cross-section.

31. The device according to claim 27 wherein a heating cable (3) is formed protectively insulated without a protective conductor braid with a doubled or reinforced insulation.

32. The device according to claim 27 wherein the connection sleeve (42) is formed mirror symmetrical relative to a center plane (45) of the clamping cut casing (43) disposed perpendicular to the longitudinal axis (27), said connection sleeve (42) having a clamping cut casing (43) as well as in each case two insulator pieces (20), clamping cutting bushes (21), seals (33), ring seals (34) and casing parts (35).

33. The device according to claim 27 further comprising at least two connection cables (2) surrounded by in each case a sealing ring (14), wherein the two connection cables (2) are led through the wall (57) of the casing cap (56) into the connection chamber (58).

34. The device according to claim 27, further comprising a casing cap (10, 56) or a casing part (35) of the connector bushing (1), of the connection sleeve (42), and of the branching bushing (55) exhibit at least one gripping recess (41) on the outside.

35. The device according to claim 27 further comprising clamping cutting edges (16, 29) bent in one direction only—from the longitudinal axis (27) of the heating cable (3), after the longitudinal axis (27) is bend with an acute angle, to the opposite walls of the channel (26), in order to press the heating cable (3) firmly in the channel (26) with edges (16,29), wherein edges (16,29) are bent to the wall of the channel (26) and edge (16) presses the cable (3) to the insulation piece (20) in a first direction and the edge (29) presses the cable (3) in a second direction disposed opposite to the first direction with some shift distance between the tips of the edges (16, 29), and wherein edges (16,29) act as wedges.

36. The device according to claim 27 wherein the channel (26) is a tubular channel.

37. The device according to claim 27 wherein the insulator piece (20) and the clamping cutting bush (21) are coupled axially shiftable to each other, wherein a locking web (22) of the clamping cutting bush (21) is supported limited slidable in a guide recess (23) of the insulator piece (20).

38. The device according to claim 37, wherein the clamping cutting bush (21) exhibits a lamellar ring (31) formed of spring elastic fingers (32) on the side disposed remote relative to the insulator piece (20), wherein they lamellar ring (31) surrounds a seal (33), wherein the conductor (5, 6) or the heating cable (3) are led through the seal (33).

39. The device according to claim 37, wherein the clamping cutting bush (21) exhibits an anullar groove, wherein a ring seal (34) resting at the inner side of the clamping cut casing (7, 43) is supported in the anullar groove.

40. The device according to claim 27, wherein the bushing (1,42, 55) exhibits a casing part (35) gripping over the clamping cut casing (7,43), wherein the casing part (35) is connected to the clamping cut casing (7,43) through a screw winding (36).

41. The device according to claim 40, wherein the casing part (35) exhibits a narrowing collar (37), wherein the narrowing collar (37) is pressable conically against the lamellar ring (31).

42. The device according to claim 41, wherein the collar (37) of the casing part (35) exhibits a web (38), wherein the web (38) engages into a slot between the fingers (32) of the lamellar ring (31).

43. The device according to claim 41, wherein the front face (39) of the casing part (35) disposed remote to the collar (37) rests at a shoulder (40) of the clamping cut casing (7,43).

44. The device according to claim 27 further comprising a floor (8, 44) of the clamping cut casing (7, 43), wherein the contact clamping cutting edge (15,53) is fixed in the floor (8, 44) of the clamping cut casing (7,43).

45. The device according to claim 44, wherein the end part (28) of the conductor (5,6) or of the heating cable (3) rests at the floor (8, 44) of the clamping cut casing (7,43).

46. The device according to claim 44, further comprising a connector chamber (11, 58);

a casing cap (10, 56) co-delimiting the connector chamber (11, 58) is disposed at the floor (8) of the clamping cut casing (7).

47. The device according to claim 46 further comprising a connection lug or tag (17) formed at the contact clamping cutting edge (15, 53), wherein the end of a connection cable (2) is led into the connection chamber (11,58) through the wall (13, 57) of the casing cap (10, 56) and at least one electrical conductor (18) of the connection cable (2) is connected to a connection lug or tag (17) of the contact clamping cutting edge (15, 53).

48. The device according to claim 47 further comprising an electrical conductor (18) of the connection cable (2) attached by way of a point welding (19) to a connection lug or tag (17).

49. The device according to claim 47, wherein the connection cable (2) is surrounded by a sealing ring (14) disposed in the wall (13, 57) of the casing cap (10, 56).

50. The device according to claim 47 wherein the casing cap (10, 56) is sealingly connected to the clamping cut casing (7,43) through an ultrasound welding (12).

* * * * *